US012351352B2

(12) United States Patent
Magnabosco et al.

(10) Patent No.: US 12,351,352 B2
(45) Date of Patent: Jul. 8, 2025

(54) BELT-TYPE VACUUM PACKAGING MACHINE

(71) Applicant: BMB S.R.L., Malo (IT)

(72) Inventors: Massimiliano Magnabosco, Torrebelvicino (IT); Sileo Vendraminetto, San Donà di Piave (IT)

(73) Assignee: BMB S.R.L., Malo (IT)

( * ) Notice: Subject to any disclaimer, the term of this patent is extended or adjusted under 35 U.S.C. 154(b) by 25 days.

(21) Appl. No.: 18/285,283

(22) PCT Filed: Mar. 28, 2022

(86) PCT No.: PCT/IB2022/052833
§ 371 (c)(1),
(2) Date: Oct. 2, 2023

(87) PCT Pub. No.: WO2022/208311
PCT Pub. Date: Oct. 6, 2022

(65) Prior Publication Data

US 2024/0182195 A1 Jun. 6, 2024

(30) Foreign Application Priority Data

Apr. 1, 2021 (IT) ..... 102021000008252

(51) Int. Cl.
*B65B 31/02* (2006.01)
*B65B 31/04* (2006.01)
(Continued)

(52) U.S. Cl.
CPC ..... *B65B 31/024* (2013.01); *B65B 31/043* (2013.01); *B65B 51/146* (2013.01)

(58) Field of Classification Search
CPC ..... B65B 31/02; B65B 31/06
(Continued)

(56) References Cited

U.S. PATENT DOCUMENTS 3,714,754 A 2/1973 Holcombe et al.
3,851,437 A * 12/1974 Waldrop ..... B65B 31/024 53/512
(Continued)

FOREIGN PATENT DOCUMENTS

WO WO-03024804 A1 * 3/2003 ..... B65B 31/02

OTHER PUBLICATIONS

International Search Report and Written Opinion for PCT/IB2022/052833, dated Jul. 6, 2022.
(Continued)

*Primary Examiner* — Anna K Kinsaul
*Assistant Examiner* — Patrick B Fry
(74) *Attorney, Agent, or Firm* — Troutman Pepper Locke LLP

(57) ABSTRACT

A belt-type vacuum packaging machine (1) comprising a base frame (2) that supports a work surface (3), a conveyor belt 4 of products (P) to be vacuum packed in bags (B) inside a vacuum chamber (10), a vacuum production system (11) that communicates with the vacuum chamber (10), welding means (12) of the bags (B) adapted to be operated after the vacuum packaging of the bags (B), an operating control panel (40) and an injection system (13) for injecting a gaseous substance into each bag (B) after the vacuum packaging is performed, in which the injection system (13) comprises a supply line (15) for the gaseous substance, interception devices of the supply line and connecting means (16) of the supply line (15) connecting to a plurality of injector nozzles (14) of the gaseous substance into the bags (B). Preferably, the injector nozzles (14) are removably fixed to the conveyor belt (4) and are accommodated in the vacuum chamber (10) together with the welding means (12) during the vacuum packaging.

16 Claims, 7 Drawing Sheets

(51) Int. Cl.
*B65B 31/06* (2006.01)
*B65B 51/14* (2006.01)

(58) Field of Classification Search
USPC ..... 53/79
See application file for complete search history.

(56) References Cited

U.S. PATENT DOCUMENTS

| | | | | |
|---|---|---|---|---|
| 4,842,123 | A * | 6/1989 | Visser | B65B 25/14 198/341.02 |
| 5,564,556 | A * | 10/1996 | Spada | B65B 19/10 198/803.13 |
| 6,862,867 | B2 * | 3/2005 | Cady | B29C 66/43121 53/512 |
| 8,099,930 | B2 * | 1/2012 | Moessnang | B65B 31/06 53/512 |
| 11,407,537 | B2 * | 8/2022 | Chevalier | B65B 57/00 |
| 2002/0020604 | A1 * | 2/2002 | Gaines | B65G 15/32 198/348 |
| 2012/0297729 | A1 * | 11/2012 | Scolaro | B65B 31/02 53/79 |
| 2021/0292019 | A1 * | 9/2021 | Chevalier | B65B 7/164 |

OTHER PUBLICATIONS

International Preliminary Report on Patentability for PCT/IB2022/052833, dated Jan. 30, 2023.

* cited by examiner

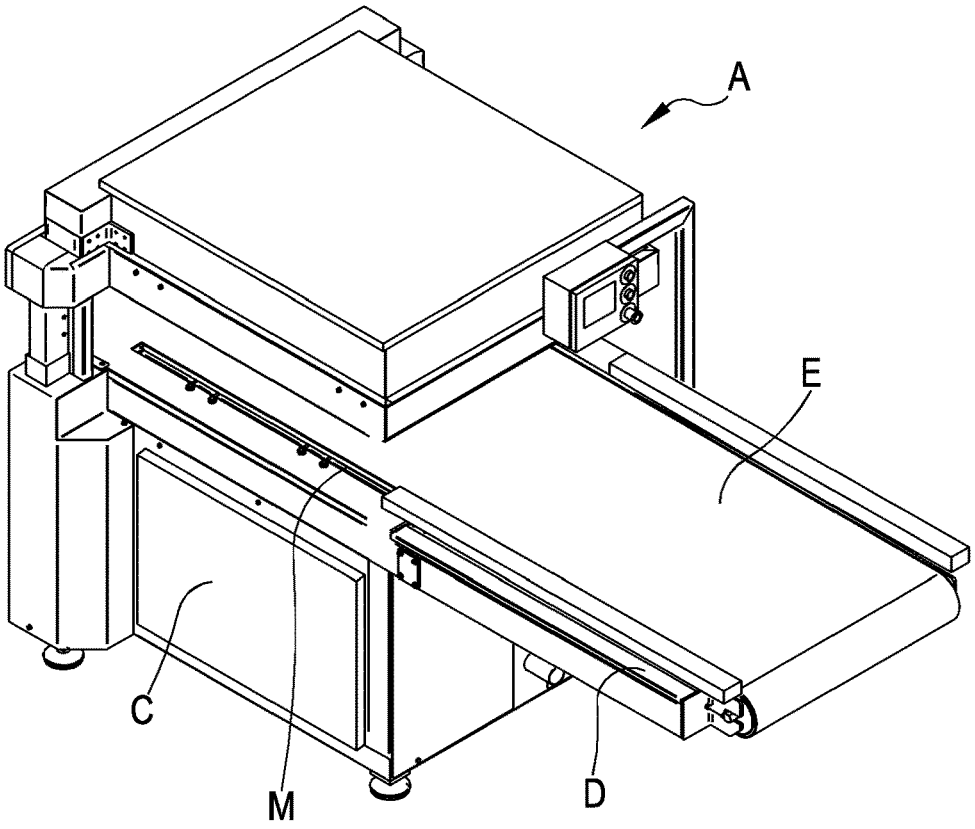
FIG. 1 - PRIOR ART
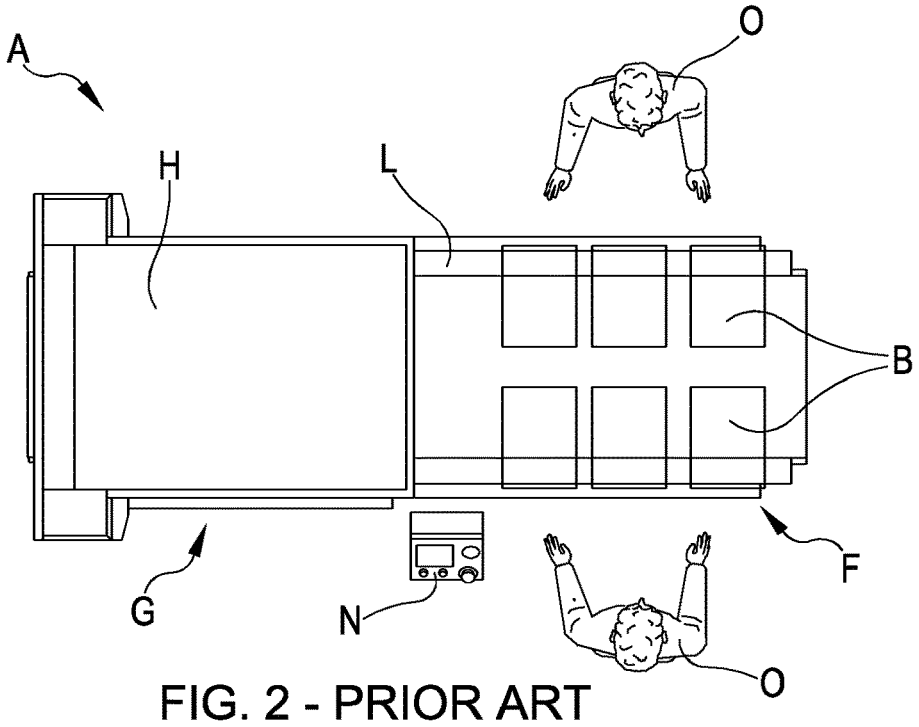
FIG. 2 - PRIOR ART

FIG.3
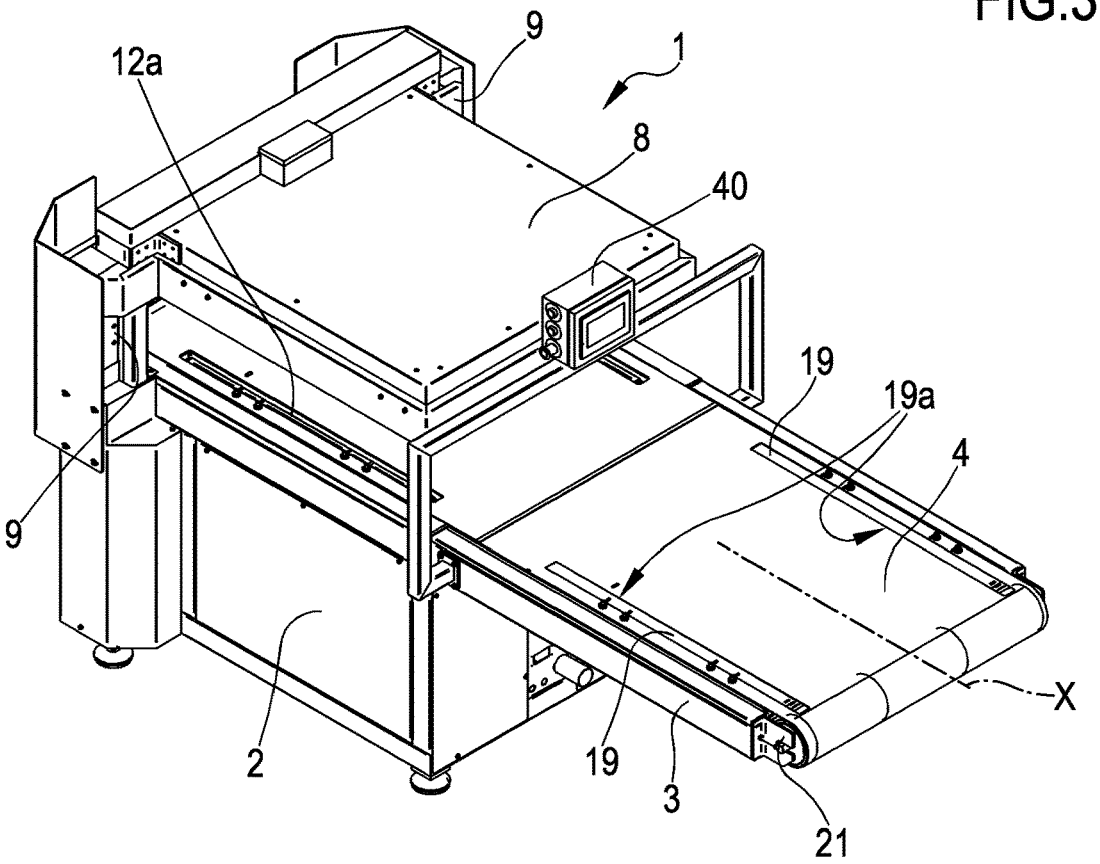
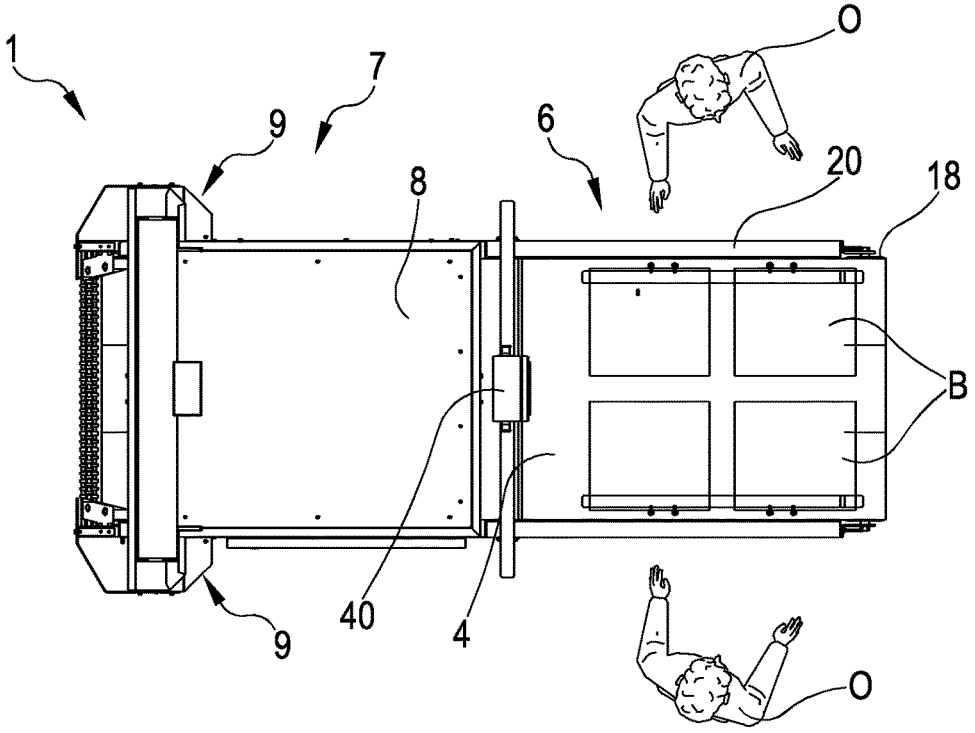
FIG.4

BELT-TYPE VACUUM PACKAGING MACHINE

This application is a national stage application under 35 U.S.C. § 371 from PCT Application No. PCT/IB2022/052833, filed Mar. 28, 2022, which claims the priority benefit of Italian Application No. 102021000008252, filed Apr. 1, 2021, which is incorporated by reference herein in its entirety.

The invention relates to an improved belt-type vacuum packaging machine, suitable to vacuum package any type of product, food in particular.

As known, vacuum packaging is a particular packaging technique which consists in storing substances, products and various objects, even clothing and garments, inside an envelope from which the air has been eliminated by means of suction. The main and widespread use of vacuum packaging is in food storage because the majority of bacteria and micro-organisms cannot proliferate in the absence of air, and this allows the food, whether cooked or raw, to be stored longer.

Moreover, the food advantageously keeps its nutritional properties, flavor, aroma and also natural color unaltered under these storage conditions.

Among known food vacuum packaging and storage methods available and at hand today, particularly important is vacuum packaging under modified atmosphere, which consists in storing the food inside containers—usually transparent and heat-sealable bags made of flexible plastic material—into which a gas or a mixture of gases, for example nitrogen, carbon dioxide, oxygen and possibly others, is introduced after applying the vacuum.

The main advantage of vacuum storage under controlled atmosphere is ensuring longer storage of the food and organoleptic properties thereof, and it is particularly recommended for improving and lengthening the storage time of fresh pasta.

Moreover, vacuum storage in controlled atmosphere allows the quantity of chemical additives usually added to the products for extending the storage thereof, to be decreased.

For these reasons, use of vacuum storage in controlled atmosphere is increasingly widespread in the field of food packaging, and accordingly the request for vacuum packaging machines able to ensure this type of packaging is increasing too.

Vacuum packaging machines in controlled atmosphere on the market are the so-called chamber machines essentially comprising a base frame that supports:

- a tank preferably made of stainless steel and configured to receive a container, usually a bag made of heat-sealable flexible material, which contains the product to be packaged;
- a cover hinged to the tank for opening and closing the tank itself in an airtight manner;
- a circuit with a vacuum pump for removing the air from the tank when the cover is closed so as to create the vacuum inside the tank and the bag;
- one or more nozzles arranged inside the tank;
- a circuit for introducing a gaseous substance into the bag through nozzles, to store the product contained in the bag;
- a welding bar and a welding counter-bar for welding the open edge of the bag;
- a control panel for controlling the operation of the packaging machine.

Operatively, the bag (or sachet), with the product to be packaged, is introduced into the tank while ensuring the nozzles are inserted in the bag itself through the open edge of the bag.

The open edge of the bag is therefore rested on the welding bar and the cover is lowered, thus creating a chamber communicating with the vacuum pump between the cover and the tank.

When the vacuum pump begins operating, air is extracted both from the chamber and from the bag until creating, in the chamber and in the bag, the degree of vacuum preselected by the user.

When the desired degree of vacuum is reached, the air extraction is stopped and a gas or a mixture of protective gases listed above is introduced into the bag through the nozzles to create, in the bag, a protective atmosphere that surrounds and protects the product.

At this point, the welding counter-bar and the underlying welding bar are mutually forced against each other to weld the edge of the bag comprised therebetween. The atmospheric pressure is restored in the tank, the cover thereof is opened and the packaged bag is removed from the tank.

The chamber vacuum packaging machines now described have features of increased reliability and versatility, making them adapted to packaging a large variety of products.

Additionally, the ease of use and limited overall dimensions thereof make them particularly adapted to being used in the field of small- and medium-sized restaurants and gastronomy.

However, the chamber vacuum packaging machines now described are limited by having an intermittent cycle, and therefore they are not adapted to continuously package large quantities of multiple types of food.

In trying to overcome such a limitation, so-called "tilting cover" vacuum packaging machines in controlled atmosphere are provided and widespread on the market, these packaging machines essentially comprising two tanks for containing the food to be packaged and a single cover that tilts so as to alternatively cover one or the other tank, in each of which the vacuum packaging is alternately produced.

Practically, the two tanks are alongside each other and an operator loads the food to be packaged in a first tank, while the vacuum packaging process is being performed in the second tank, which is closed by the cover.

The packaged product is removed from the first tank at the end of packaging, and the cycle is repeated by introducing the new product to be packaged into the second tank.

Machines of this type allow the dead times to be reduced, and therefore production to be increased, however they are not capable of packaging in a continuous cycle and therefore they are not adapted for the industrial production of large quantities of products vacuum packed in modified atmosphere.

Indeed, for the industrial production of vacuum packed food belt vacuum packaging machines are indeed used which actually able to package food products of any kind in heat-sealable bags and in a substantially continuous cycle. A machine of this type of the prior art is depicted in accompanying FIG. 1, where it is indicated as a whole by A and where it is worth noting that it comprises a base frame C which in the upper part thereof defines a work surface D on which a conveyor belt E slides, on which the bags B containing the products to be vacuum packed observed in FIG. 2 are arranged.

Bag-guide conveyors L arranged at the sides of the conveyor belt E are fixed on the work surface D and serve to guide and support the edge of the bags B placed thereon.

The conveyor belt E transfers the preformed bags B with the products therein which the operators O arranged thereon from the loading area F up to the packaging area G, where there is a packaging chamber H.

When the packaging chamber H is arranged in contact with the conveyor belt E, the vacuum is created therein so as to define a vacuum chamber in which the bags B confined inside the packaging chamber H are subjected to the vacuum packaging process.

There is, on the work surface D and on the continuity of the bag-guide conveyors L, a welding bar M which is fixed to the work surface D and is arranged outside the lateral edges of the conveyor belt E, while a welding counter-bar (not shown in FIG. 1), opposed to the welding bar M, is fixed inside the packaging chamber H. Therefore, the welding bar M and the welding counter-bar are placed inside the packaging chamber H when it is lowered and facing the conveyor belt E.

A control panel N which the operators O access to control the packaging machine is fixed to the base frame C.

Operatively, with reference to FIG. 1, the packaging provides for the bagged products to be arranged above the conveyor belt E with the edges of the preformed bags B arranged resting on the bag-guide conveyors L and for the subsequent advancement of the conveyor belt E to transfer the products bagged below the packaging chamber H.

Since the edges of the bags B are arranged resting on the bag-guide conveyors L and given that the welding bar M is arranged on the continuity of the same bag-guide conveyors L, when the conveyor belt E transfers the preformed bags B into the packaging area G at the packaging chamber H, the edge of the bags B is positioned on the welding bar M in position to be welded when the welding counter-bar is pushed against the welding bar M.

The packaging chamber H is then lowered and when the edge thereof adheres to the work surface D and conveyor belt E, the air is removed from the inner cavity thereof, which becomes the vacuum chamber in which the vacuum packaging occurs of the bags B with the products contained therein.

Therefore, the welding of the edge of the preformed bags B occurs by means of the welding bar M and the welding counter-bar which mutually sandwich such an edge of bag B comprised therebetween.

When the packaging chamber H is raised, the conveyor belt D is put into motion and the vacuum packed products are unloaded from the packaging machine A.

At the same time, further bagged products to be vacuum packed, which in the meantime were arranged in the loading area F, are transported to the height of chamber H for a new vacuum packaging cycle.

It is therefore understood from the above description that the belt vacuum packaging machines of the known type are capable of providing a substantially continuous automated production cycle and therefore are particularly adapted to industrial employment where large production is required.

Particularly, packaging machines of this type are used by fresh products production and packaging companies supplying small and large-scale distributors. However, these belt-type vacuum packaging machines of the known art present the recognized drawback of not being capable of providing vacuum packaging with subsequent introduction into the bags of gaseous substances to create a modified atmosphere therein which is useful for improved storage of the product contained in the bags.

On the other hand, packaging machines of this type are not present on the market and manufacturers offering belt-type vacuum packaging machines for packaging food products in modified atmosphere are not known to the Applicant.

This means that, in the current background art, products which are vacuum packed in modified atmosphere may be obtained only by using discontinuous systems, with undoubtedly much higher production costs (cost of the raw materials and labor employed also being equal) with respect to those encountered in the belt-type vacuum packaging systems of the prior art that however do not allow vacuum packaging in modified atmosphere.

Prior document published under WO03/024804 A1 in any case shows a more evolved type of vacuum packaging machine which is more closely comparable with the belt-type vacuum packaging machine of the invention by providing a system for introducing gas into the bag where the vacuum was already created. Thus, the present invention aims to overcome the above-described drawbacks of the known art.

In particular, it is main purpose of the invention to provide a belt-type vacuum packaging machine which allows packaging vacuum products in modified atmosphere in a continuous cycle.

It is another purpose of the current invention to indicate a belt-type vacuum packaging machine which allows a vacuum packed product in modified atmosphere to be obtained, the production cost of which is less than the production cost currently encountered for similar products which are necessarily produced in discontinuous cycle vacuum packaging machines.

Listed purposes are achieved by a belt-type vacuum packaging machine as in accompanying claim 1, to which reference is made and which is not indicated in this section for the sake of brevity of description.

Further detailed technical features of the belt-type vacuum packaging machine of the invention are described in the dependent claims.

The aforesaid claims, hereinafter specifically and concretely defined, are intended an integral part of the present description.

Advantageously, the use of the packaging machine of the invention allows the continuous cycle packaging of vacuum packed products in modified atmosphere. Again advantageously, the products that are vacuum packed by employing the packaging machine of the invention have increased preservation time with respect to equal products that are vacuum packed using belt vacuum packaging machines of the prior art.

Said purposes and advantages will be more apparent from the description that follows, related to a preferred embodiment of the belt-type vacuum packaging machine of the invention, given by way of indicative and non-limiting example, with the help of the accompanying drawings, in which:

FIGS. 1 and 2 are two separate views (assonometric and plan view, respectively) of a belt-type vacuum packaging machine of the prior art;

FIG. 3 is an assonometric view of the belt-type vacuum packaging machine of the invention;

FIG. 4 is the plan view of FIG. 3;

Figure 7:
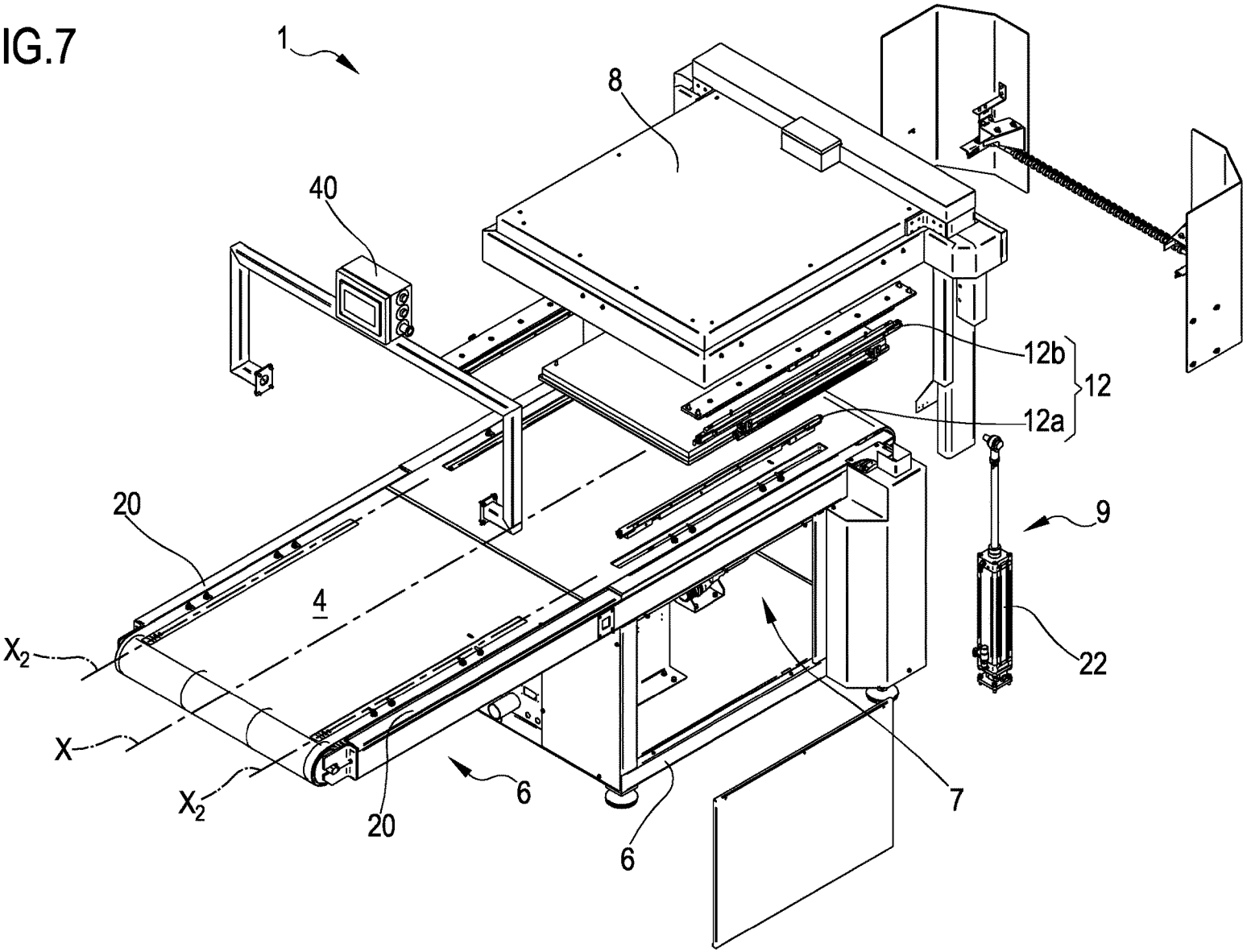
FIGS. 7 and 8 are two separate exploded assonometric views of the packaging machine of the invention.
Figure 8:
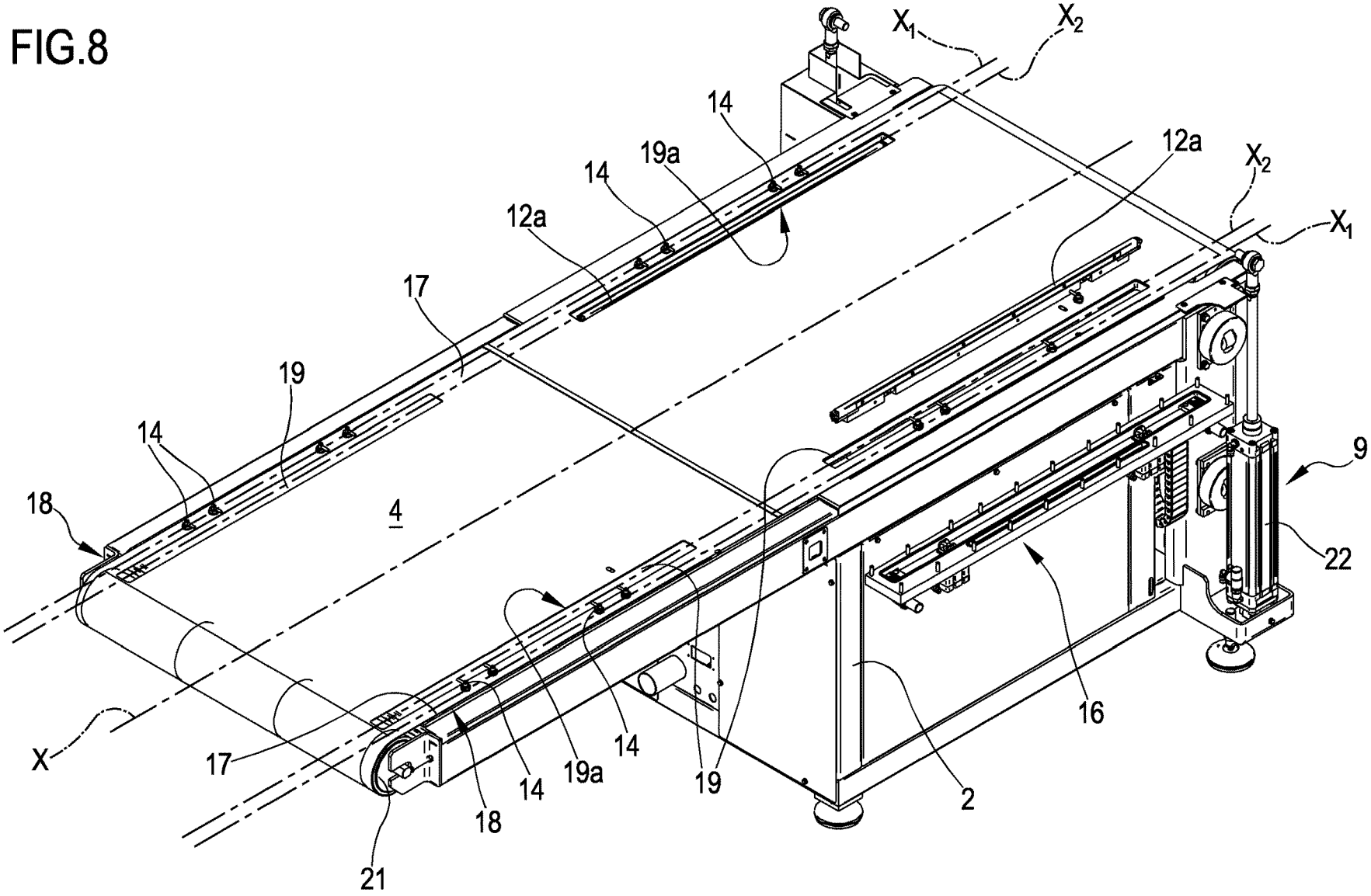

The belt-type vacuum packaging machine of the present invention is depicted in its entirety in FIGS. 3 and 4, in an exploded view in FIG. 7, and in a partial view in FIG. 8, where it is indicated as a whole by numeral 1.

Figure 5:
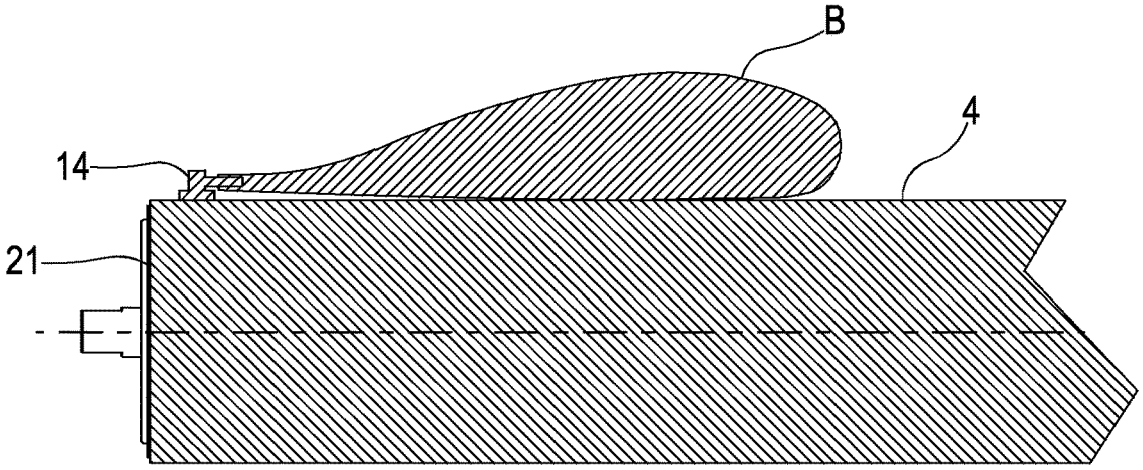
FIGS. 5 and 6 are two separate diagrammatic details of the packaging machine in FIG. 4.
Figure 6:
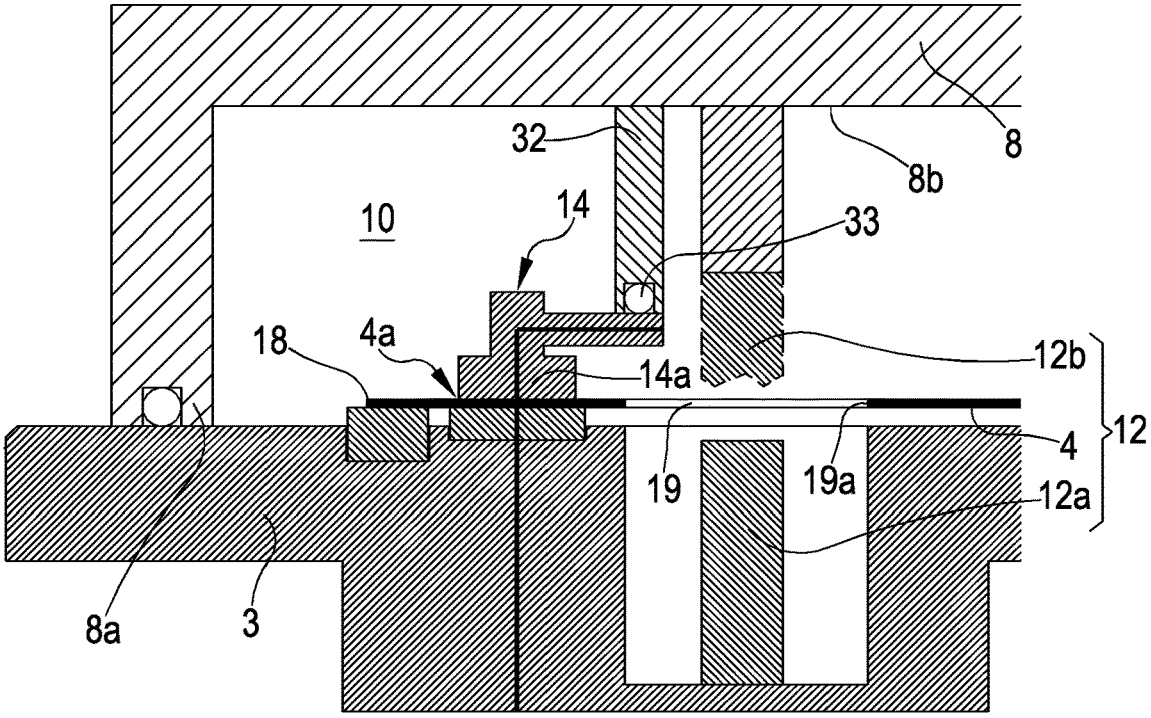
Figure 9:
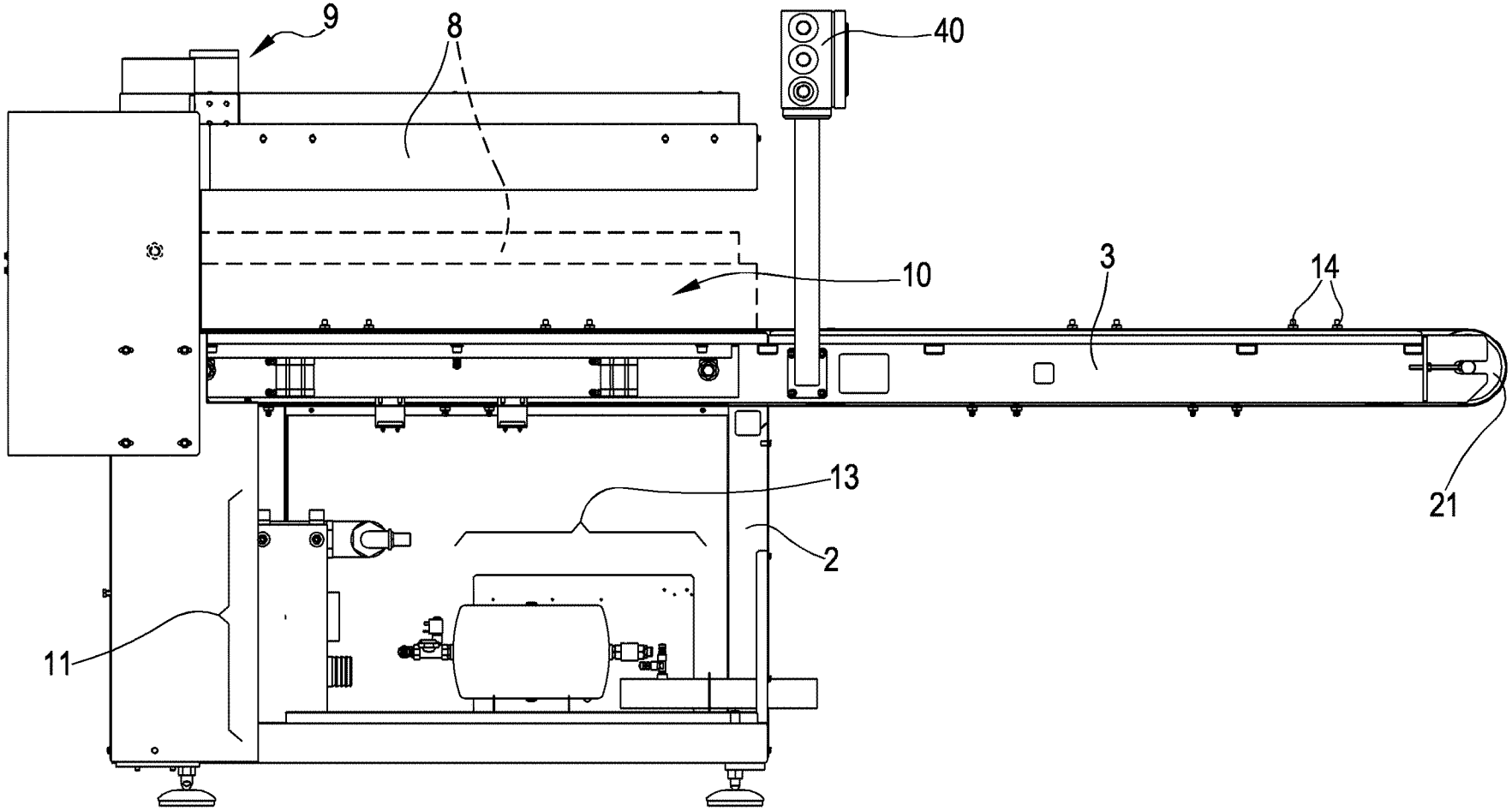
FIG. 9 is a side view of the packaging machine of the invention.
Figure 10:
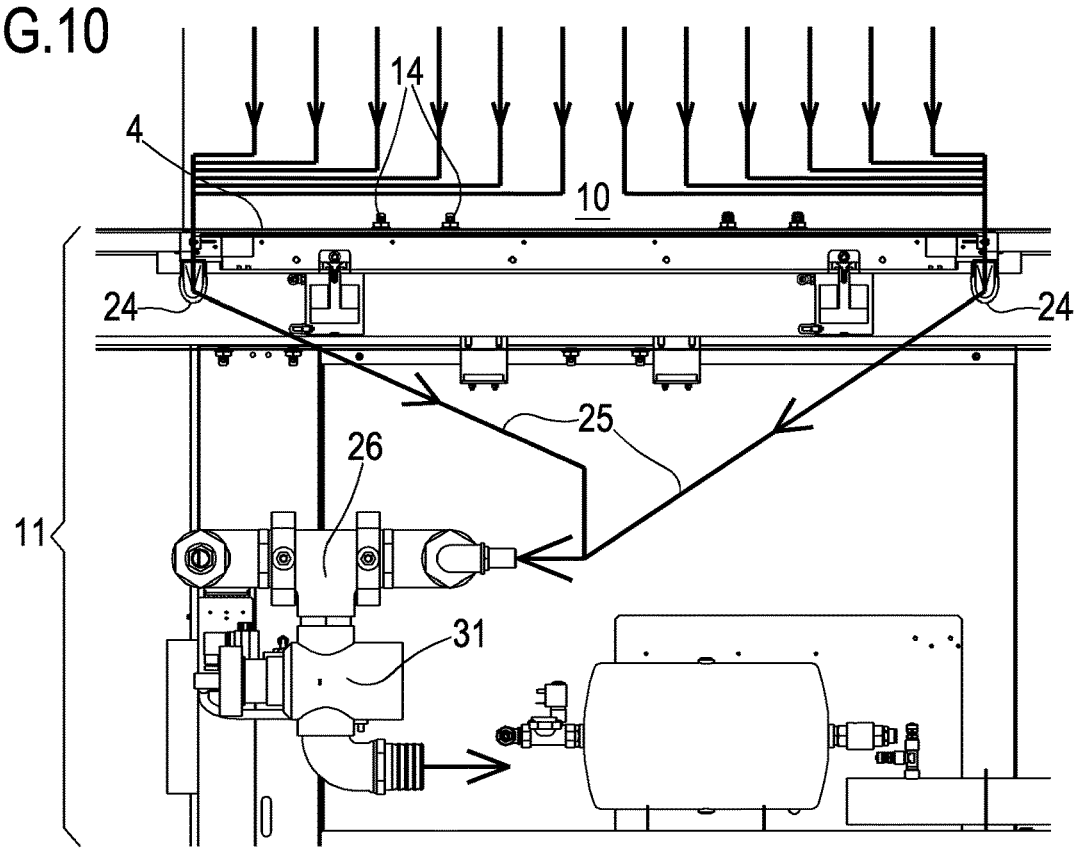
FIGS. 10 and 11 are two separate diagrammatic and enlarged views of a portion of the packaging machine in FIG. 9.
Figure 11:
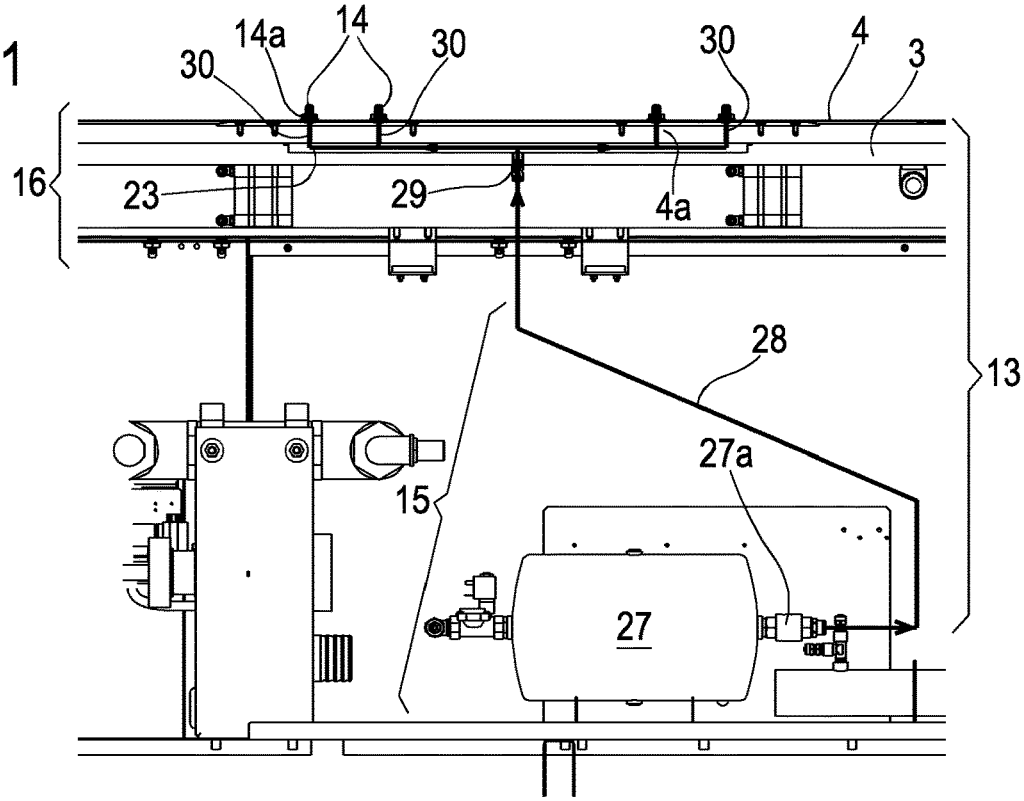

The belt vacuum packaging machine 1 of the invention, expressly intended to package products, generally food products, is also shown in a side view in FIG. 9, while FIGS. 10 and 11 show enlargements of parts thereof, and the remaining FIGS. 5 and 6 show diagrammatic details thereof.

Finally, it should be noted that for descriptive brevity, the vacuum packaging machine 1 of the invention is simply indicated with the term "packaging machine 1" in the continuation.

With reference to the drawings, it is worth noting that the packaging machine 1 comprises a base frame 2 which supports a work surface 3 which develops in length according to a longitudinal direction X.

A conveyor belt 4 developing along the same longitudinal direction X of the work surface 3 slidingly acts on the work surface 3 and is configured to transfer the products to be vacuum packed contained in preformed bags B from a loading area 6 to a packaging area 7 of the same work surface 3 (shown in FIGS. 3 and 4). Advancements means (not shown in the drawings because they are in themselves known) of the conveyor belt 4 rotate at least one of two or more mutually parallel drums (or rollers) 21 revolvingly supported by the base frame 2 on which the conveyor belt 4 is wound in a loop.

A pair of mutually parallel lateral guides 20, which develop according to the longitudinal direction X defined by the conveyor belt 4 and with respect to which they're symmetrically arranged on opposite sides, are fixed on the work surface 3. The conveyor belt 4 is comprised between the lateral guides 20, since the width of the conveyor belt 4 is less than the distance between the lateral guides 20.

A packaging chamber 8, which is arranged above the work surface 3 and is connected to the displacement means 9 which allow the approaching and distancing thereof with respect to the work surface 3 and with respect to the conveyor belt 4, is present in the packaging area 7.

Preferably, but not exclusively, the displacement means 9 comprise one or more fluid actuators 22 which are interposed between the base frame 2 and the packaging chamber 8, but in another embodiment, the displacement means 9 could comprise electric motors which rotate ball screws supported by the base frame 2 and connected to the packaging chamber 8.

In the described embodiment, the packaging chamber 8 has substantially parallelepiped shape and, as shown in FIG. 7, the displacement means 9 comprise two fluid actuators 22, one of which is shown in FIG. 7, which are arranged at two adjacent corners of the packaging chamber 8.

In another embodiment, not shown, there could also be a different number of fluid actuators positioned in a different manner.

When the packaging chamber 8 is moved close to the conveyor belt 4 and the perimetric edge 8*a* thereof comes into contact with the work surface 3 and with the upper surface of the conveyor belt 4 (as shown in FIGS. 6 and 9), a vacuum chamber 10 is defined in which the products contained in the preformed bags B are vacuum packed.

For this purpose, the packaging machine 1 comprises a vacuum production system 11, which is depicted in detail in FIG. 10 showing that it comprises: a vacuum pump of the known type—not shown in the drawing because arranged outside the packaging machine 1—which is connected to the vacuum valve 31, intake manifolds 24 which are connected to the work surface 3 and which communicate with the vacuum chamber 10, and intake ducts 25, each of which connects the intake mouth 26 of the vacuum valve 31 with one of the intake manifolds 24.

In the preferred but not exclusive embodiment of the packaging machine 1 under description, there are two intake manifolds 24 and two intake ducts 25.

It is understood that this embodiment of the vacuum production system 11 is only one of the possible multiple embodiments which may be selected by a manufacturer.

The vacuum packaging machine 1 also comprises welding means 12 of the preformed bags B after the vacuum packaging which, as it can be noted in particular in FIGS. 7 and 8, comprise a pair of welding bars 12*a* fixed to the work surface 3 and a pair of welding counter-bars 12*b*, each opposed to a respective welding bar 12*a*, which are fixed to the packaging chamber 8.

Finally, it is worth noting that the mutually overlapping welding bars 12*a* and welding counter-bars 12*b* are aligned according to two mutually parallel directions and arranged symmetrically and on opposite sides of the longitudinal direction X defined by the conveyor belt 4.

More in detail, each welding counter-bar 12*b* is fixed inside the packaging chamber 8 and therefore, when such a packaging chamber 8 is lowered and defines the vacuum chamber 10, also each welding bar 12*a* and the opposed welding counter-bar 12*b* are contained in the vacuum chamber 10.

With regards in particular to the welding counter-bars 12*b*, one of them is depicted in FIG. 6 which shows that it is fixed to the canopy 8*b* of the packaging chamber 8 and protrudes and is aligned with the underlying welding bar 8*a* belonging to the work surface 3.

Specifically, the welding counter-bar 12*b* and the welding bar 12*a* in FIG. 6 are arranged spaced apart from each other since they come into mutual contact only when bag B comprised therebetween is welded, as better explained below when the operating step of the packaging machine 1 is described.

Finally, there is an operating control panel 40 on the packaging machine 1 of the invention, the functions of which are described in greater detail below when the packaging machine 1 is described in operating step.

According to the invention, the packaging machine 1 comprises at least one injection system 13 of at least one inert gaseous substance into each preformed bag B received in the vacuum chamber 10, wherein such an introduction occurs after the vacuum production system 10 has created the vacuum in each preformed bag B, and wherein the aforesaid injection system 13 comprises a plurality of injector nozzles 14 configured to be connected to the preformed bags B and be turned towards the inside of the same preformed bags B when the bags B are arranged on the conveyor belt 4.

In particular, it is worth noting in FIG. 11 that the injection system 13 preferably comprises:

- a supply line 15 of the gaseous substance;
- connecting means, indicated as a whole by numeral 16, of the supply line 15 to the injector nozzles 14 when the injector nozzles 14 are arranged inside the vacuum chamber 10;
- interception devices, not shown in the accompanying drawings, configured to open and close the flow of the gaseous substance along the supply line 15.

As for the supply line 15 of the gaseous substance, FIG. 11 shows that it comprises a storage tank 27 which is connected to an external line (not depicted), from which it receives the gaseous mixture under pressure, and a delivery pipe 28 which connects the delivery mouth 27*a* of the storage tank 27 to the connecting means 16.

In a preferred but non-binding manner, the connecting means 16 in turn comprise:

- at least one collecting chamber 23 provided in the thickness of the work surface 3;
- at least one inlet duct 29 also provided in the thickness of the work surface 3, which puts the delivery pipe 28 in communication with the collecting chamber 23;
- a plurality of outlet ducts 30, also provided in the thickness of the work surface 3, each of which puts the collecting chamber 23 in communication with at least one of the injector nozzles 14.

As far as the injector nozzles 14 are concerned, the accompanying drawings, and particularly the detailed diagrammatic FIGS. 5 and 6, show that they belong to the conveyor belt 4 and each one is fixed in a through hole 4*a* made in the conveyor belt 4.

Since integral with the conveyor belt 4, the injector nozzles 14 and the preformed bags B they support therefore are movable together with the conveyor belt 4 itself, and this advantageously allows creating the vacuum and introducing the inert gaseous substance in atomized form into the different preformed bags B which are progressively to be packaged in a more continuous and quicker manner with respect to the known vacuum packaging machines, thus resulting in an improved hourly production for the vacuum packaging machine 1 of the invention with respect to the prior art, by a single operator who always remains stationary at the loading area 6 of the vacuum packaging machine 1.

In this context, prior document U.S. Pat. No. 3,714,754 shows a system for creating the vacuum in an apparatus for vacuum packaging products contained in preformed bags (numeral 15), each of which is temporarily and removably applied to an extractor member (numeral 7 and consisting of a protruding cylindrical duct) which is integral and fixed to, or incorporated in a conveyor belt (numeral 13): exclusively and only the creation of the vacuum inside the preformed bag occurs through each extractor member, which significantly protrudes upwardly from the outer surface of the conveyor belt.

Therefore, if on one hand prior document WO03/024804 A1 shows the presence of fixed or at most, rotating sprayer nozzles not coupled to the conveyor belt, and through which a gas (for example, carbon dioxide or a mixture thereof and other gaseous elements) is introduced into the preformed bag where the vacuum was already created, on the other hand prior document U.S. Pat. No. 3,714,754 shows simple protruding cylindrical ducts which are integral with the conveyor belt and which are never defined as injectors, through which the air is only extracted or sucked from the bags to create the vacuum therein.

As a result, starting from prior document WO03/024804 A1 and prior document U.S. Pat. No. 3,714,754 also being available, the skilled person could not easily, immediately and unequivocally arrive at one of the significant technical concepts of the present invention, that is that the injection system 13—by means of which at least one gaseous substance is introduced into each of the preformed bags B after the vacuum production system 10 has created the vacuum in each of such preformed bags B—in the vacuum packaging machine 1 herein claimed comprises a plurality of injector nozzles 14 belonging to the conveyor belt 4 which are configured to be connected to the preformed bags B and to be turned facing towards the inside of the latter when the preformed bags B are arranged on the conveyor belt 4 and used to spray atomized inert gas therein.

Moreover, each injector nozzle 14 inside the respective through hole 4*a* preferably is fixed by means of screw means 14*a* (which in particular are noted in the detail depicted in FIG. 6) and which therefore provide a removable fastening of the injector nozzles 14 to the conveyor belt 4 to allow the possible replacement thereof.

Moreover, the injector nozzles 14 are aligned and spaced apart from each other one after the other along two straight directions $X_1$ which are spaced apart from and parallel to each other and are symmetrically arranged and parallel with respect to the longitudinal direction X defined by the conveyor belt 4.

More in detail, it is worth noting that the injector nozzles 14 are fixed on two side bands 17 of the conveyor belt 4, which are parallel to each other and are symmetrically arranged with respect to the longitudinal direction X defined by the conveyor belt 4.

Additionally, each lateral band 17 is comprised between edge 18 delimiting the conveyor belt 4 and a plurality of slits 19 which are made in the conveyor belt 4 and are aligned and spaced apart one after the other along two straight directions $X_2$ which are spaced apart from, and parallel to each other and parallel and symmetrically arranged with respect to the longitudinal direction X defined by the conveyor belt 4.

It is also worth noting that profile 19*a* of each slit 19 is configured to receive the through insertion of the welding means 12 which are arranged at the packaging area 7 and are aligned with the longitudinal alignment directions $X_2$ of the slits 19, as shown in particular in FIG. 7.

More specifically, as already noted above, FIG. 7 shows that each welding bar 12*a* is associated with the work surface 3 below the conveyor belt 4 and that each welding counter-bar 12*b* is opposed to the welding bar 12*a* and is arranged inside the packaging chamber 8, it being fixed to and protruding from the canopy 8*b* of the packaging chamber 8 itself.

As also already mentioned, there are two welding bars 12 and two welding counter-bars 12*b* that are aligned parallel to the same longitudinal alignment directions $X_2$ of the slits 19.

FIG. 6 also shows that there is a pressure rod 32 protruding towards the injector nozzles 14 inside the packaging chamber 8: the pressure rod 32 is fixed to canopy 8*b* of the packaging chamber 8, is arranged alongside each welding counter-bar 12*b* and is provided at the end with a gasket 33.

As it will be explained during the description of the operation of the vacuum packaging machine 1 of the current invention, when the packaging chamber 8 is lowered to create the vacuum chamber 10, each pressure rod 32 advantageously and conveniently keeps the preformed bag B adhering to the injector nozzles 14 during the injection of the gaseous mixture, by means of gasket 33 with which it is provided.

When the packaging chamber 8 is lowered, it is worth noting in FIG. 6 that the perimetric edge 8*a* thereof comes into contact with the work surface 3 to define, together with the surface of the conveyor belt 4, the vacuum chamber 10.

The welding means 12, the pressure rods 32 and the injector nozzles 14 which, as indicated, are supplied with the gaseous mixture directly from the collecting chamber 23 of the injection system 13 which is made in the thickness of the work surface 3, are contained under these conditions inside the vacuum chamber 10.

Substantially, it is the described constructive solution which provides applying the injector nozzles 14 to the conveyor belt 4 and supplying them inside the vacuum chamber 10 with the gaseous mixture originating from the supply line 15 passing through the work surface 3 which has allowed to provide the packaging machine 1 of the invention which, unlike the majority of conventional belt-type vacuum packaging machines of the prior art, allows a gaseous mixture providing the protective modified atmosphere of the product contained therein, to be injected into the preformed bags B.

Indeed, the passage of the gaseous mixture through the work surface 3 is allowed by the connecting means 16 that comprise the collecting chamber 23, the inlet duct 29 and the outlet ducts 30, which are made through the thickness of the work surface 3.

Albeit not depicted, there necessarily is a control station provided with a dedicated software operatively connected to detection means (not shown or at least not marked with their own numeral below) that are configured to verify when the injector nozzles 14 are arranged at the respective outlet ducts 30 of the collecting chamber 23 and here, open the interception devices of the supply line 15 to supply the gaseous mixture to the injector nozzles 14 and inject it into the preformed or premade bags B.

Each welding bar 12*a* and each welding counter-bar 12*b* come into mutual contact and provide the welding of bag B comprised therebetween when:

- the packaging chamber 8 is lowered and defines the vacuum chamber 10 that contains the welding bars 12*a*, the welding counter-bars 12*b* and the injector nozzles 14;
- one of the slits 19 is arranged in coincident position above each welding bar 12*a* and below each welding counter-bar 12*b;*
- thrust means, not depicted, force each welding bar 12*a* and each welding counter-bar 12*b* mutually against each other.

It is worth noting that in the embodiment of the packaging machine 1 described, when the packaging chamber 8 is lowered and defines the vacuum chamber 10, the thrust means act on the welding bar 12*a* and force it against the above welding counter-bar 12*b* to weld the preformed bags B.

In another embodiment of the invention (not depicted), the thrust means could instead act on the welding counter-bar or on both.

Therefore, there will also be suitable sensor means, for example of the photocell or proximity type (not depicted in the following drawings and operatively connected to the control station), for determining the correct positioning and mutual alignment of the slits 19 with the respective welding bars 12*a* and welding counter-bars 12*b* prior to the lowering of the packaging chamber 8 and prior to the operation of the thrust means for welding the preformed bags B.

Operatively, the packaging in the vacuum packaging machine 1 of the current invention starts by arranging the preformed bags B with the product to be packaged therein on the conveyor belt 4, as depicted in FIG. 4.

Particularly, the edge of each preformed bag B in which there is the opening for inserting the product to be packaged is arranged above a slit 19 and the injector nozzles 14 are inserted through the opening thereof.

In the case described, there are two injector nozzles 14 for each preformed bag B, although it is to be understood that other embodiments of the invention, not shown in the following, may also have a different number, notably a greater number. Then, the conveyor belt 4 transfers the preformed bags B from the loading area 6 to the packaging area 7 below the packaging chamber 8 which is lowered until the perimetric edge 8*b* thereof adheres to the work surface 3, as noted in FIG. 6 and FIG. 9.

Thus, the vacuum chamber 10 is formed, in which the pressure rods 32 ensure, by means of the gaskets 33 thereof, the adhesion of the preformed bags B to the injector nozzles 14 during the injection of the inert gaseous substance.

The vacuum production system 11 sucks air so as to create the vacuum inside the vacuum chamber 10 in addition to inside the preformed bags B contained therein and, once the vacuum is obtained in the preformed bags B, the supply system 13 (separate from the vacuum production system 11) injects the gas mixture therein, through the supply nozzles 14, thus creating the modified atmosphere which improves the protection of the vacuum product contained therein.

The successive sealing operation of the preformed bags B by means of welding, which is performed by means of the welding means 12, completes the packaging of the products contained in the bags B themselves.

It's worth noting that in order for the welding to be more effectively performed, the welding bars 12*a* and corresponding welding counter-bars 12*b*, which are constructively opposite each other and are located within the periphery delimited by the vacuum chamber 10, are arranged on opposite sides of and coincide with the perimetric edge 19*a* of the respective slits 19 in the conveyor belt 4.

Indeed, only if these conditions occur will each welding bar 12*a* and the corresponding welding counter-bar 12*b* come into mutual contact by both passing through slit 19 when they are mutually moved by the respective thrust means.

In particular, as already mentioned, the thrust means force each welding bar 12*a* against the respective welding counter-bar 12*b* in the embodiment described.

Therefore, the operating panel 40 controls the packaging machine and controls the thrust means of the welding bars 12*a* and the welding counter-bars 12*b* to perform the welds, controls the correct positioning of the injector nozzles 14 with respect to the injection system of the gaseous substance, controls the correct positioning of the slits 19, controls that the vacuum production system 11 and the supply system 13 of the gaseous substance to be injected into the bags are performed automatically and in a continuous cycle by the control station and dedicated software.

Moreover, it is worth noting that the described packaging machine 1 of the present invention is configured to simultaneously package four preformed bags B but it is apparent that this is only one of the possible configurations thereof, which may provide the simultaneous packaging of any number of preformed bags B.

In light of the description provided above, it is, therefore, understood that the belt-type vacuum packaging machine of the present invention achieves the purposes and reaches the advantages indicated above.

In particular, the invention achieves the preset object of making a belt-type vacuum packaging machine which allows products to be obtained which are vacuum packed in a modified atmosphere which cannot be obtained with the belt vacuum packaging machines available on the market.

It is reiterated that these results were achieved for the specific construction combination conceived and that provides for the injector nozzles 14 to be fixed in through holes 4*a* made in the conveyor belt 4 and to be supplied when they are inside the vacuum chamber 10 with the gaseous mixture to be injected into the preformed bags B which is conveyed by the injection system 13 through the work surface 3.

The vacuum packaging machine of the invention also allows a vacuum packed product to be obtained which has improved storage conditions with respect to an equivalent product packaged by means of belt vacuum packaging machines of the known type.

Finally, it is apparent that several other variants may be made to the belt-type vacuum packaging machine in question, within the limited scope of the appended claims, just as it is apparent that any materials, shapes and sizes of the details shown may be used as needed in the practical implementation of the invention, and may be replaced by other technically equivalent elements.

Where the construction features and techniques mentioned in the successive claims are followed by reference signs or numerals, such reference signs were introduced for the sole purpose of increasing the intelligibility of the claims themselves, and therefore such reference signs have no limiting effect on the interpretation of each element identified by way of example only by such reference signs.

The invention claimed is:

1. Belt-type vacuum packaging machine for packaging products contained in preformed bags, comprising:

a base frame-which supports a work surface which mainly develops along a longitudinal direction;

a conveyor belt system comprising a conveyor belt which extends along said longitudinal direction above said work surface and is configured to transfer products contained in preformed bags from a loading area to a packaging area;

a packaging chamber arranged in said packaging area above said work surface and said conveyor belt;

displacement actuator system coupled to displace said packaging chamber with respect to said work surface and said conveyor belt;

a vacuum chamber configured to receive said products contained in said bags to be vacuum packed, said vacuum chamber being defined between the inside of said packaging chamber and an upper surface of said conveyor belt when a perimetric edge of said packaging chamber is arranged in contact with said work surface and said conveyor belt;

at least one vacuum production system that communicates with said vacuum chamber;

a welding system configured to weld said preformed bags adapted to be operated after vacuum packaging;

at least one injection system of at least one gaseous substance into each of said preformed bags after said vacuum production system has created the vacuum in each of said preformed bags, said injection system comprising a plurality of injector nozzles that are configured to be connected to said preformed bags and be turned towards the inside of said preformed bags when said preformed bags are arranged on said conveyor belt, characterized in that each of said injector nozzles is connected to said conveyor belt and is fixed in a through hole made in said conveyor belt;

wherein said welding system is arranged at said packaging area and include a pair of welding bars fixed to said work surface and a pair of welding counter-bars, each opposed to a respective welding bar, fixed inside said packaging chamber and protruding from a canopy of said packaging chamber, said welding bars and said welding counter-bars being symmetrically arranged with respect to said longitudinal direction defined by said conveyor belt and aligned along said straight alignment directions of a plurality slits;

wherein each of said welding bars and each of said welding counter-bars opposite to each other are configured to mutually come into contact by passing through a respective one of said slits and weld each of said preformed bags in between them when: said packaging chamber is lowered and defines said vacuum chamber that contains said welding bar, said welding counter-bar and said injector nozzles; each of said welding bars and each of said welding counter-bars opposite to each other are arranged to coincide with a respective one of said slits, wherein one of said welding bars is below and one of said welding counter-bars is above a corresponding one of said slits, and wherein each of said welding bars is configured for movement mutually against each of said welding counter-bars through a corresponding one of said slits.

2. Packaging machine according to claim 1, wherein t each of said injector nozzles is removably fixed to said conveyor belt through screw mechanism.

3. Packaging machine according to claim 1, wherein said injector nozzles are aligned and spaced apart from each other one after the other along two straight directions that are spaced apart from and parallel to each other and are parallel and symmetrically arranged with respect to said longitudinal direction defined by said conveyor belt.

4. Packaging machine according to claim 1, wherein said injector nozzles are fixed on two side bands of said conveyor belt which are parallel to each other and are parallel and symmetrically arranged with respect to said longitudinal direction defined by said conveyor belt.

5. Packaging machine according to claim 4, wherein each of said side bands is between an edge delimiting said conveyor belt and said plurality of slits that are made in said conveyor belt.

6. Packaging machine according to claim 5, wherein said slits are aligned and spaced apart from each other one after the other along two straight directions which are spaced apart from and parallel to each other and are parallel and symmetrically arranged with respect to said longitudinal direction defined by said conveyor belt.

7. Packaging machine according to claim 1, further comprises a pair of pressure rods present inside said packaging chamber and fixed to said canopy of said packaging chamber in such a way as to protrude towards said injector nozzles, each of said pressure rods being arranged alongside a respective welding counter-bar and being provided with a gasket.

8. Packaging machine according to claim 1, further comprises a pair of mutually parallel lateral guides that are fixed to said work surface and develop along said longitudinal direction defined by said conveyor belt with respect to which said lateral guides are spaced apart, parallel and symmetrically arranged, the distance between said lateral guides being less than the width of said conveyor belt that is received between said lateral guides.

9. Packaging machine-according to claim 1, wherein said conveyor belt system comprises at least one gear motor adapted to rotate at least one of two or more drums with mutually parallel axes and revolvingly supported by said base frame on which said conveyor belt is wound in a closed loop.

10. Packaging machine according to claim 1, wherein said displacement actuator system comprises one or more fluid actuators interposed between said base frame and said packaging chamber.

11. Packaging machine according to claim 1, wherein said vacuum production system includes:

at least one vacuum pump;

a vacuum valve connected to said vacuum pump;

one or more intake manifolds connected to said work surface and communicating with said vacuum chamber;

one or more intake ducts each of which connects an intake mouth of said vacuum valve with one of said intake manifolds.

12. Packaging machine according to claim 1, wherein said injection system of at least one gaseous substance includes:

a supply line of said gaseous substance to said injector nozzles;

a connection system that connects said supply line to said injector nozzles when said injector nozzles are arranged inside said vacuum chamber;

interception devices configured to open and close the flow of said gaseous substance along said supply line.

13. Packaging machine according to claim 12, wherein said supply line of said gaseous substance comprises a vessel containing said gaseous substance under pressure and a delivery pipe that connects a delivery mouth of said vessel to said connection system.

14. Packaging machine according to claim 12, wherein said connection system comprise:

at least one collecting chamber;

at least one inlet duct that puts said delivery pipe in communication with said collecting chamber;

a plurality of outlet ducts, each of which puts said collecting chamber in communication with at least one of said injector nozzles when said injector nozzles are positioned in said vacuum chamber.

15. Packaging machine according to claim 14, wherein said collecting chamber, said inlet duct and said outlet ducts are in said work surface and allow said gaseous substance coming from a vessel of said supply line to pass through said work surface to reach said injector nozzles.

16. Belt-type vacuum packaging machine for packaging products contained in preformed bags, comprising:

a base frame-which supports a work surface which mainly develops along a longitudinal direction;

a conveyor belt system comprising a conveyor belt which extends along said longitudinal direction above said work surface and is configured to transfer products contained in preformed bags from a loading area to a packaging area;

a packaging chamber arranged in said packaging area above said work surface and said conveyor belt;

displacement actuator system coupled to displace said packaging chamber with respect to said work surface and said conveyor belt;

a vacuum chamber configured to receive said products contained in said bags to be vacuum packed, said vacuum chamber being defined between the inside of said packaging chamber and an upper surface of said conveyor belt when a perimetric edge of said packaging chamber is arranged in contact with said work surface and said conveyor belt;

at least one vacuum production system that communicates with said vacuum chamber;

welding system configured to weld said preformed bags adapted to be operated after vacuum packaging;

at least one injection system of at least one gaseous substance into each of said preformed bags after said vacuum production system has created the vacuum in each of said preformed bags, said injection system comprising a plurality of injector nozzles that are configured to be connected to said preformed bags and be turned towards the inside of said preformed bags when said preformed bags are arranged on said conveyor belt, characterized in that each of said injector nozzles belongs to said conveyor belt and is fixed in a through hole made in said conveyor belt;

wherein said injector nozzles are fixed on two side bands of said conveyor belt which are parallel to each other and are parallel and symmetrically arranged with respect to said longitudinal direction defined by said conveyor belt;

wherein each of said side bands is between an edge delimiting said conveyor belt and a plurality of slits that are made in said conveyor belt; and wherein the profile of each of said slits is configured to receive the through insertion of said welding system.

* * * * *